US005967119A

United States Patent [19]

Burkhard et al.

[11] Patent Number: 5,967,119

[45] Date of Patent: Oct. 19, 1999

[54] ELECTRONICALLY VARIABLE PRESSURE CONTROL

[75] Inventors: James Frank Burkhard, Churchville; Kenneth John Dauer, Avon, both of N.Y.

[73] Assignee: General Motors Corporation, Detroit, Mich.

[21] Appl. No.: 09/038,303

[22] Filed: Mar. 11, 1998

[51] Int. Cl.[6] ..... F02M 55/00

[52] U.S. Cl. ..... 123/458; 123/511

[58] Field of Search ..... 123/510, 511, 123/457, 458, 462, 514, 456

[56] References Cited

U.S. PATENT DOCUMENTS

| | | | |
|---|---|---|---|
| 3,614,945 | 10/1971 | Schlagmuller et al. | 123/179 |
| 3,827,409 | 8/1974 | O'Neill | 123/458 |
| 4,235,211 | 11/1980 | Sugaya | 123/511 |
| 4,300,509 | 11/1981 | Schechter | 123/456 |
| 4,353,385 | 10/1982 | Maisch et al. | 123/511 |
| 5,207,203 | 5/1993 | Wagner et al. | 123/514 |
| 5,367,999 | 11/1994 | King et al. | 123/458 |
| 5,425,342 | 6/1995 | Ariga et al. | 123/456 |

*Primary Examiner*—Thomas N. Moulis
*Attorney, Agent, or Firm*—Kark F. Barr, Jr.; Vincent A. Cichosz

[57] ABSTRACT

The invention relates to a fuel pressure control system for an electromechanical fuel injection system. The fuel injection system includes a fuel rail for receiving pressurized fuel from a fuel source and operable to supply pressurized fuel to a fuel injector. The fuel rail pressure control system includes a pressure regulator having a flexible diaphragm separating a reference pressure chamber and a fuel chamber. The fuel chamber has a fuel inlet and a fuel outlet. The flexible diaphragm operates to open and close the fuel outlet to balance forces between the reference pressure chamber and the fuel chamber. The fuel chamber is in fluid communication with the fuel rail at the fuel inlet and in fluid communication with a fuel return line at the fuel outlet. The fuel rail pressure control system further includes a bypass fuel inlet line in fluid communication with the fuel rail and the reference pressure chamber, a bypass fuel outlet line in fluid communication with the reference pressure chamber and the fuel return line, a variable valve component disposed within the bypass fuel inlet line, and an orifice disposed within the bypass fuel outlet line. The variable valve component operates to vary fuel pressure in the reference pressure chamber to thereby proportionately vary pressure in the fuel chamber and the fuel rail.

5 Claims, 2 Drawing Sheets

ELECTRONICALLY VARIABLE PRESSURE CONTROL

TECHNICAL FIELD

The present invention relates to a fuel pressure control system for an electromechanical fuel injection system.

BACKGROUND OF THE INVENTION

In certain engine applications it may be desirable to develop a flexible fuel delivery system that provides for a greater range of achievable fuel flow rates through the fuel injector. This range, referred to as the dynamic range, is defined as the ratio between the maximum and the minimum controllable fuel flow rates. In a pulse-width-modulated fuel injector, the fuel flow is not actually controllable at the upper and lower bounds of the injector flow range due to physical constraints. For example, a fuel injector will not open if the pulse delivered to the injector is shorter than the time required for the injector solenoid to energize and open the injector valve. Likewise, a fuel injector will not close if the time between pulses is shorter than the time required for the fuel injector solenoid to deenergize and close the injector valve. These physical conditions limit the dynamic range by bounding the minimum and maximum controllable flow rates.

The fuel flow rate through an injector is directly affected by two factors, fuel pressure and the time an injector is open. The flow rate may be modified by adjusting the open injector time while maintaining a substantially constant fuel pressure. Flow rate may also be varied by altering the fuel pressure with the fuel pump speed. This method requires an extensive electronic control system, specialized hardware, and a relatively expensive fuel pump.

SUMMARY OF THE INVENTION

The invention is an electronic, continuously variable, fuel pressure control system for an electromechanical fuel injection system. The control system varies the pressure in a fuel rail at a fuel injector inlet in order to vary injector dynamic range using fuel pressure. The system includes a pressure regulator and a variable valve component such as a solenoid valve. The solenoid valve is operable to modulate and vary fuel flow through the pressure regulator. In response to the changing pressure in the pressure regulator, the pressure in the fuel rail responds proportionately.

DESCRIPTION OF THE PREFERRED EMBODIMENT

Figure 1:
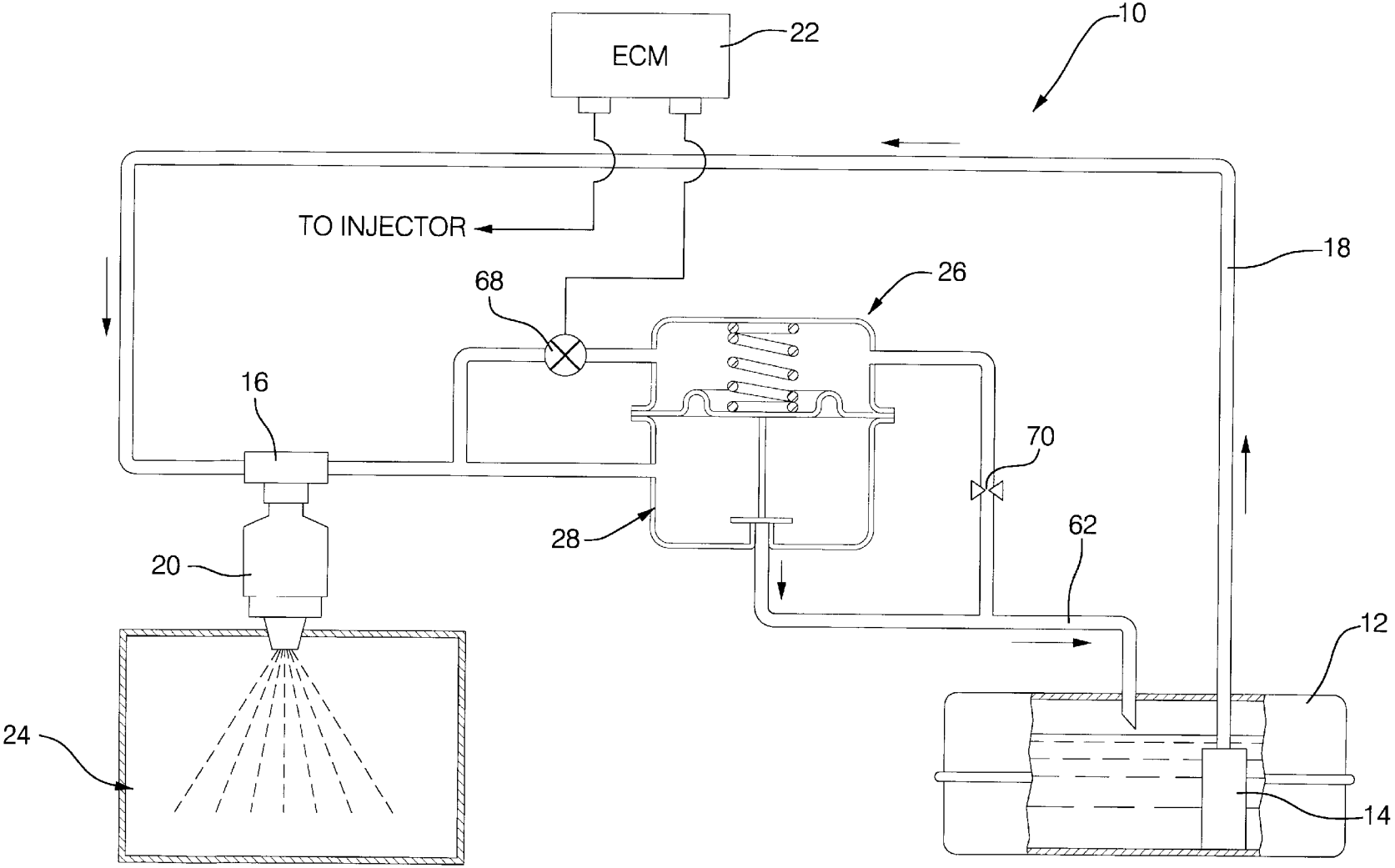
FIG. 1 is a schematic diagram of a fuel delivery system including an embodiment of the present invention.

FIG. 1 illustrates a fuel system, designated generally as 10, for use in supplying fuel to an internal combustion engine, not shown. The fuel system 10 includes a fuel source 12, such as a fuel tank, in which may be disposed a fuel pump 14. The fuel pump 14 delivers pressurized fuel to a fuel rail 16 through a fuel supply line 18 which extends between the fuel source 12 and the fuel rail 16. The fuel rail 16 is operable to distribute the pressurized fuel to one or more fuel injectors 20. Each fuel injector 20 includes a solenoid operated valve assembly, not shown, which opens in response to an energizing signal from an engine control module 22 to establish a flow path for fuel through the injector 20 to the intake 24 of the engine.

Figure 2:
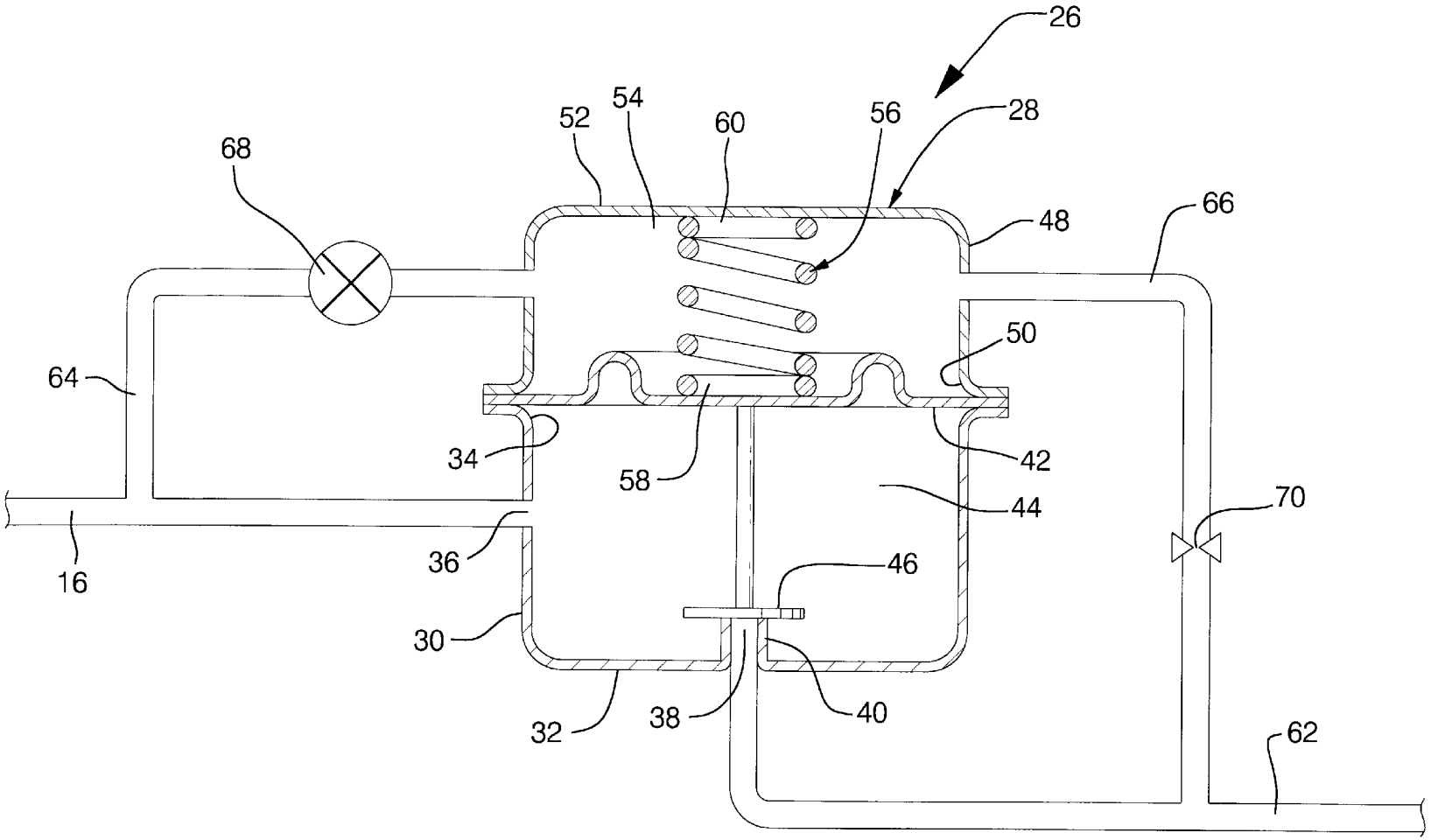
FIG. 2 is a schematic diagram of the present invention.

Regulation of the fuel pressure within the fuel rail 16 is through a fuel rail pressure control system 26, FIG. 2. The fuel rail pressure control system 26 includes a pressure regulator 28. The pressure regulator 28 has a cup shaped lower housing 30 with a closed first end 32 and an open second end 34, a fuel inlet 36, and a fuel outlet 38. The fuel outlet 38 has a valve seat 40 extending thereabout. A flexible diaphragm 42 closes the open second end 34 of the lower housing 30 to define, with the lower housing, a fuel chamber 44. A valve element 46 is positioned to seat on, and close, the valve seat 40. The valve element 46 is operable by the flexible diaphragm 42 wherein, in response to movement of the diaphragm, the valve element 46 lifts off of the valve seat 40 to open the fuel outlet 38 and allow fuel to exit the fuel chamber 44.

The pressure regulator 28 also has a cup shaped upper housing 48 with an open first end 50 and a closed second end 52. The flexible diaphragm 42 closes the open first end 50 of the upper housing 48 to define, with the upper housing, a reference pressure chamber 54. A compression spring 56 abuts at one end 58 to the flexible diaphragm 42 and at a second end 60 to the upper housing 48. The spring 56 is operable to exert a biasing force upon the flexible diaphragm 42 and a valve seating force upon the valve element 46.

The pressure regulator 28 is in fluid communication with the fuel rail 16 through the inlet 36 of the fuel chamber 44 and in fluid communication with a fuel return line 62 through the outlet 38 of the fuel chamber 44. The fuel return line 62 returns fuel from the fuel chamber 44 to the fuel source 12 when the valve element 46 is lifted off of the valve seat 40.

The fuel rail pressure control system 26 further includes two bypass fuel lines, a bypass fuel inlet line 64 and a bypass fuel outlet line 66. The bypass fuel inlet line 64 is in fluid communication with the fuel rail 16 and the reference pressure chamber 54 and the bypass fuel outlet line 66 is in fluid communication with the reference pressure chamber 54 and the fuel return line 62. A variable valve component 68, such as a solenoid valve is disposed within the bypass fuel inlet line 64, and a restriction such as an orifice 70 is disposed within the bypass fuel outlet line 66. The solenoid valve 68 is operable to modulate and to variably admit fuel to the reference pressure chamber 54. Upon admission of fuel to the reference pressure chamber 54, the orifice 70 is operable to restrict fuel flow through the bypass fuel outlet line 66, increasing the pressure in the reference pressure chamber 54.

Based on an electronic signal from the engine control module 22, the solenoid valve 68 will modulate to variably admit fuel into the reference pressure chamber 54 which modifies the reference pressure. This causes an imbalance of forces on the two sides of the diaphragm 42. In response to the imbalance, the diaphragm 42 will move the valve element 46 to either bleed pressure or build pressure in the fuel chamber 44 until the forces on the diaphragm balance. Due to the force-balance nature of the device, any change to the reference pressure affected by the solenoid valve 68 actuation will result in a change to the fuel rail pressure. This pressure control system 26 results in a continuously adjustable fuel rail pressure.

By increasing the modulation of the solenoid valve 68, pressure in the reference pressure chamber 54 increases thereby increasing fuel pressure in the fuel chamber 44 and in the fuel rail 16. By reducing the modulation of the solenoid valve 68, pressure in the reference pressure chamber 54 decreases thereby decreasing fuel pressure in the fuel chamber 44 and in the fuel rail 16.

To reduce the fuel rail pressure to the lowest pressure setting, the solenoid valve 68 is closed. The reference pressure will drop to the pressure in the fuel return line 62 and the only significant force opposing the fuel chamber pressure is the spring force. Since the fuel chamber pressure is greater than the spring force, the diaphragm moves upward lifting the valve element off of the valve seat 40, opening the fuel outlet 38 to reduce pressure until the fuel chamber pressure, and thus the fuel rail pressure, equals the spring force.

To increase the fuel rail pressure to the highest pressure setting, the solenoid valve 68 is opened. Fuel at fuel rail pressure will enter the reference pressure chamber 54. Due to the orifice 70 downstream, the pressure in the reference pressure chamber 54 will increase due to back pressure. This increased reference pressure will apply an increased valve seating force on the diaphragm 42, keeping the valve element 46 seated to build pressure in the fuel chamber 44 until the fuel chamber pressure, and thus the fuel rail pressure, equals the sum of the reference pressure and the spring force.

To adjust the fuel rail pressure to midrange pressure settings, the solenoid valve 68 is pulsewidth modulated. The longer the pulsewidth (time the solenoid valve 68 is open), the higher the reference pressure and, as a result, the fuel chamber pressure and fuel rail pressure will increase. The shorter the pulsewidth, the lower the reference pressure, resulting in a decreased fuel rail pressure.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims

We claim:

1. A fuel system comprising:

a fuel rail for receiving pressurized fuel from a fuel source and operable to supply pressurized fuel to a fuel injector, a fuel rail pressure control system including a pressure regulator, said pressure regulator having a flexible diaphragm separating a reference pressure chamber and a fuel chamber, said fuel chamber having a fuel inlet and a fuel outlet, said flexible diaphragm operable to open and close said fuel outlet to balance forces between said reference pressure chamber and said fuel chamber, said fuel chamber in fluid communication with said fuel rail at said fuel inlet and in fluid communication with a fuel return line at said fuel outlet, said fuel rail pressure control system further comprising a bypass fuel inlet line in fluid communication with said fuel rail and said reference pressure chamber, a bypass fuel outlet line in fluid communication with said reference pressure chamber and said fuel return line, and a variable valve component disposed within said bypass fuel inlet line and operable to vary fuel pressure in said reference pressure chamber to thereby proportionately vary pressure in said fuel chamber and said fuel rail.

2. A fuel system according to claim 1, further comprising a valve seat extending about said fuel outlet, a valve element positioned to seat and close said valve seat, said valve element operable by said flexible diaphragm, and movable off of said valve seat, in response to movement of said diaphragm, to open said fuel outlet allowing fuel to exit said fuel chamber.

3. A fuel system according to claim 2, further comprising a compression spring abutting at one end to said flexible diaphragm and at a second end to said pressure regulator, said spring operable to exert a biasing force upon said flexible diaphragm and a valve seating force upon said valve element.

4. A fuel system according to claim 1, said variable valve component comprising a solenoid valve, said solenoid valve operable to modulate and to admit fuel to said reference pressure chamber, and an orifice disposed within said bypass fuel outlet line and operable, upon admission of fuel in said reference pressure chamber by said solenoid valve, to increase pressure in said reference pressure chamber by restricting fuel flow through said bypass fuel outlet line, wherein increasing modulation of said solenoid valve, increases pressure in said reference pressure chamber thereby increasing fuel pressure in said fuel chamber and said fuel rail and wherein reducing modulation of said solenoid valve, decreases pressure in said reference pressure chamber thereby decreasing fuel pressure in said fuel chamber and said fuel rail.

5. A fuel system comprising:

a fuel rail for receiving pressurized fuel from a fuel source and operable to supply pressurized fuel to a fuel injector, a fuel rail pressure control system including a pressure regulator, said pressure regulator having a cup shaped lower housing with a closed first end and an open second end, a fuel inlet and a fuel outlet, said fuel outlet having a valve seat extending thereabout, a flexible diaphragm closing said open second end of said lower housing to define with said lower housing a fuel chamber, a valve element positioned to seat on and close said valve seat, said valve element operable by said flexible diaphragm, and moveable off of said valve seat in response to movement of said diaphragm to open said fuel outlet allowing fuel to exit said fuel chamber, said pressure regulator further comprising a cup shaped upper housing with an open first end and a closed second end, said flexible diaphragm closing said open first end of said upper housing to define with said upper housing a reference pressure chamber, a compression spring abutting at one end to said flexible diaphragm and at a second end to said upper housing, said compression spring operable to exert a biasing force upon said flexible diaphragm and a valve seating force upon said valve element, said pressure regulator further in fluid communication with said fuel rail at said fuel inlet of said fuel chamber and in fluid communication with a fuel return line at said fuel outlet of said fuel chamber, said fuel return line returns fuel to said fuel source when said valve element is lifted off of said valve seat, said fuel rail pressure control system further comprising a bypass fuel inlet line in fluid communication with said fuel rail and said reference pressure chamber, a bypass fuel outlet line in fluid communication with said reference pressure chamber and said fuel return line, a solenoid valve disposed within said bypass fuel inlet line, and an orifice disposed within said bypass fuel outlet line, said solenoid valve operable to modulate and to admit fuel to said reference pressure chamber, and said orifice operable, upon admission of fuel to said reference pressure chamber, to restrict fuel flow out of said reference pressure chamber, to increase pressure in said reference pressure chamber, wherein increasing modulation of said solenoid valve, increases pressure in said reference pressure chamber thereby increasing pressure in said fuel chamber and said fuel rail, and reducing modulation of said solenoid valve, decreases pressure in said reference pressure chamber thereby decreasing fuel rail pressure.

* * * * *